United States Patent [19]

Wissink et al.

[11] Patent Number: 4,484,484

[45] Date of Patent: Nov. 27, 1984

[54] POWER TRANSMITTING DEVICE FOR AN OIL WELL PUMP

[75] Inventors: Ronald L. Wissink; James A. Munsch, both of Oshkosh, Wis.

[73] Assignee: Rockwell International Corporation, Pittsburgh, Pa.

[21] Appl. No.: 245,472

[22] Filed: Mar. 19, 1981

[51] Int. Cl.[3] ..... F04B 47/02

[52] U.S. Cl. ..... 74/41; 74/665 T; 74/424

[58] Field of Search ..... 74/41, 423, 424, 665 S, 74/665 T, 710, 713, 417, 665 GB

[56] References Cited

U.S. PATENT DOCUMENTS

| | | | |
|---|---|---|---|
| 1,424,446 | 8/1922 | Buckendale | 74/665 T |
| 2,557,937 | 6/1951 | Buckendale | 74/713 |
| 2,573,948 | 11/1951 | Bernard | 74/41 |
| 3,213,700 | 10/1965 | Brownyer | 74/424 |
| 3,427,887 | 2/1969 | Jones | 74/41 |
| 4,034,621 | 7/1977 | Ritter | 74/424 |
| 4,275,609 | 6/1981 | De Laney | 74/41 |
| 4,379,413 | 4/1983 | Brammer et al. | 74/710.5 |

FOREIGN PATENT DOCUMENTS

| | | | |
|---|---|---|---|
| 1430849 | 5/1969 | Fed. Rep. of Germany | 74/665 T |
| 519267 | 1/1921 | France | 74/665 T |
| 404636 | 1/1934 | United Kingdom | 74/424 |

OTHER PUBLICATIONS

"National Unit Pumper," The National Supply Company, Bulletin No. 289, Dec. 14, 1940.

"The Story of Planetary Axles," Rockwell-Standard Corp., 1959.

*Primary Examiner*—Lawrence J. Staab

[57] ABSTRACT

A power transmitting device for an oil well pump of the type which utilizes a rotating power source and provides an input capable of operating a pair of cranks for driving a reciprocating pump. The power transmitting device includes a first speed reducer having an input shaft with a pinion bevel gear mounted thereon with the input shaft being operably connected to the power source. The first speed reducer also includes a ring bevel gear in meshing engagement with the pinion bevel gear which is fixedly mounted on a intermediate location of a rotatable output shaft. The output shaft operates a second speed reducer at each end thereon which is capable of providing an output which can be directly coupled to the cranks. The invention includes a method of manufacturing utilizing a number of existing components.

7 Claims, 6 Drawing Figures

POWER TRANSMITTING DEVICE FOR AN OIL WELL PUMP

BACKGROUND OF THE INVENTION

1. Field of the Invention

This invention relates to a power transmitting' device for use in an oil well pump and, more specifically, to such a device which provides speed reduction from a single input shaft which is driven by a rotating power source to two output shafts which are capable of driving a crank means to provide the power to a reciprocating pumping device of the oil well pump and to a method for making the same.

2. Description of the Prior Art

It is common in the oil industry to utilize reciprocating oil well pumps of the type which are powered by a rotating power source. Typically, the power source is an electric motor although diesel driven engines or the like could also be utilized. Because electric motors and engines operate more efficiently at higher speeds and the reciprocating motion of the pump is at a significantly lower speed, some speed reduction is required in the transmission of power from the power source to the reciprocating pump. Although some reduction in speed can be produced at the output of the motor through a belt and pulley or chain drive means, it has been found preferable to include a power transmitting device which includes significant speed reduction between the power source and the pump.

U.S. Pat. Nos. 1,972,660; 1,979,803; 3,183,728; 3,427,887; 3,621,723; 3,706,234; 3,867,846 and 4,051,736 disclose oil well pumps of the type mentioned above and, because of the forces required to operate the pumps, teach that it is advantageous to utilize a dual pitman or connecting rod configuration for balanced loading on the power transmitting device and other pump components. Each includes dual output shaft means from a power transmitting, speed reducing device which drive some type of crank arms for the operation of the pitmen. It is common to include counterweights on the crank arms for even loading during operation of the pump. However, the walking beam configurations to which the pitmen are connected are of various designs as are the means employed for coupling the power source to the input of the speed reducer.

Although the speed reducers utilized in the oil well pumps disclosed in the patents mentioned hereinabove might differ, they each appear to utilize a single input shaft which drives a series of spur, helical or herringbone gears to transmit the power to the output shaft. The output shaft is parallel to the input shaft and has crank means mounted at each end thereof. While these types of power transmitting, speed reducers appear to be most common in recent oil well pump installations, there has heretofore been utilized other gear means for transmitting power from and reducing the speed of the power source. U.S. Pat. Nos. 1,821,216; 1,858,185; 1,915,827; 2,161,298; 2,197,730; 3,208,291 and 3,221,569 include speed reducers having input shafts which are not parallel to the output shafts. A number of these speed reducers can be seen to include worm gear drives although the detailed operation of others is not fully disclosed. In any case, they each disclose that the output shaft is directly coupled to a single or dual crank means for the operation of the reciprocating pump.

While any number of these devices might have been and continue to be successfully utilized in the oil pumping field, there remains a need to provide a power transmitting speed, reducing device which is reliable and inexpensive to provide. Obviously, any power transmitting speed, reducing device, which might be more efficient than the spur, helical, herringbone or worm gear devices used heretofore, would be desirable to reduce the design requirements and operating costs for the power source. Additionally, any such installation should include means for effectively maintaining or repairing the power transmitting, speed reducer device as quickly and conveniently as possible so there would be less interference with the operation of the oil well pump.

SUMMARY OF THE INVENTION

It is, therefore, an object of this invention to provide a power transmitting device for an oil well pump which is reliable and efficient and is capable of being easily maintained.

It is a further object of this invention to provide such a power transmitting device which can be inexpensively manufactures.

It is another object of this invention to be able to manufacture such a device as much as possible with existing components which have been extensively utilized under similar operating conditions and have a proven reliability.

These and other objects of the invention are provided in a preferred embodiment thereof including a power transmitting device for an oil well pump of the type which utilizes a rotating power source and provides an output capable of operating crank means for driving a reciprocating pump means. The power transmitting device includes a first speed reducing means including an input shaft means having pinion bevel gear means mounted thereon with the input shaft means being operably connected to the power source. The first speed reducing means includes a ring bevel gear means in meshing engagement with the pinion bevel gear means and being fixedly mounted at an intermediate location on a rotatable output shaft means. There is included means for coupling each of the opposite ends of the output shaft means to the crank means. The invention can also include the provision of a second speed reducing means at the opposite ends of the output shaft means which includes an output hub to which the crank means can be directly coupled. The invention also includes a method of manufacturing the power transmitting device including the utilization of existing components.

DESCRIPTION OF THE PREFERRED EMBODIMENT

Figure 1:
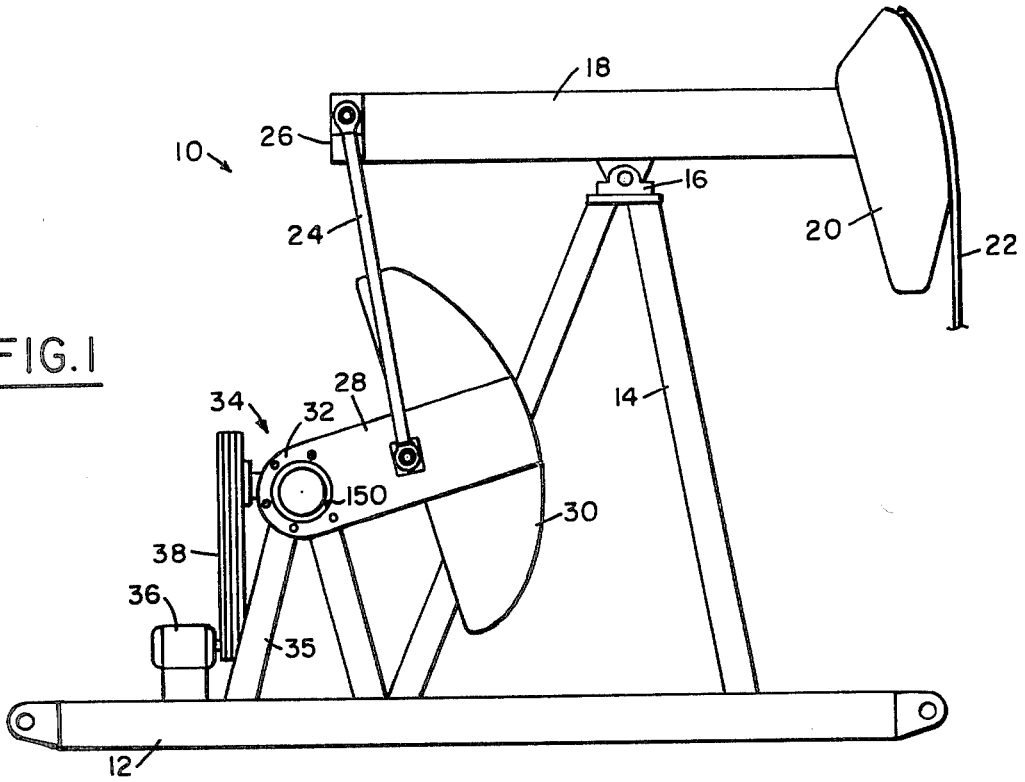
FIG. 1 is a side elevational view of an oil well pump including the preferred embodiment of the invention.
Figure 2:
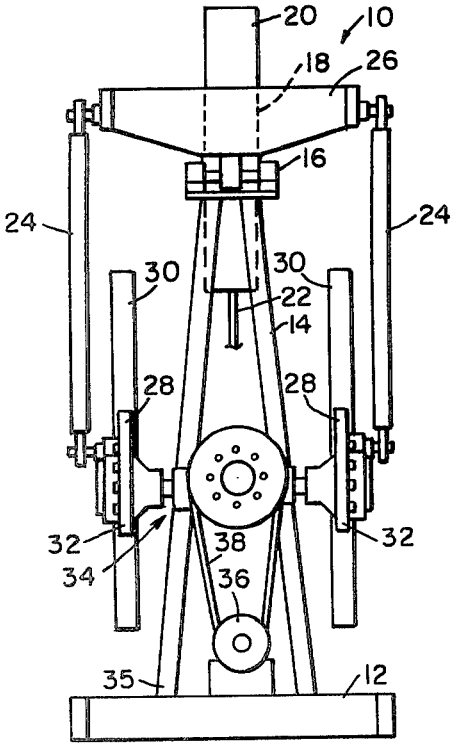
FIG. 2 is an end view of the oil well pump as shown in FIG. 1.

As seen in FIGS. 1 and 2, a typical oil well pump 10 is mounted on a base 12 which can be made of concrete or other permanent structure or can be made of steel to allow the pump 10 to be capable of being moved to different sites. A samsom frame 14 extends upwardly from the base 12 and includes a saddle bearing 16 at the upper end thereof. The saddle bearing 16 pivotally supports a walking beam 18 which has a mule head 20 mounted on its forward end. A bridle cable 22 is connected to the upper end of an oil well pump rod (not shown) in a manner well known in the oil industry.

To impart reciprocal motion to the walking beam 18, a pair of pitmen or connecting rods 24 are joined at their upper ends through an equalizing connector 26 which is secured to the rear end of the walking beam 18. The lower end of each pitman 24 is pivotally joined to a crank arm 28 having a suitable counterweight 30. Each crank arm 28 is mounted for rotation at an end 32 to one of the outputs of a power transmitting device 34 supported by a frame 35.

Figure 4:
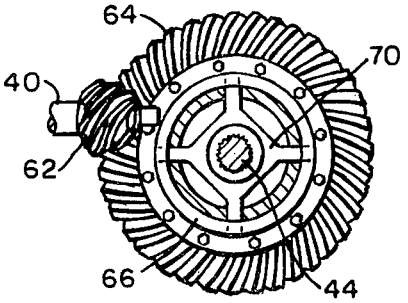
FIG. 4 is a view of the first speed reducer in the embodiment shown in FIG. 3 as generally seen along line 4—4.
Figure 5:
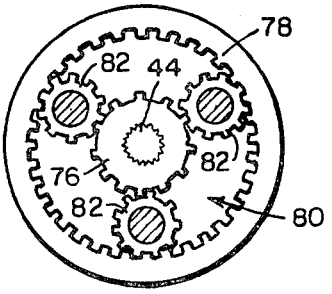
FIG. 5 is a simplified view of the embodiment shown in FIG. 3 as generally seen along line 5—5.
Figure 3:
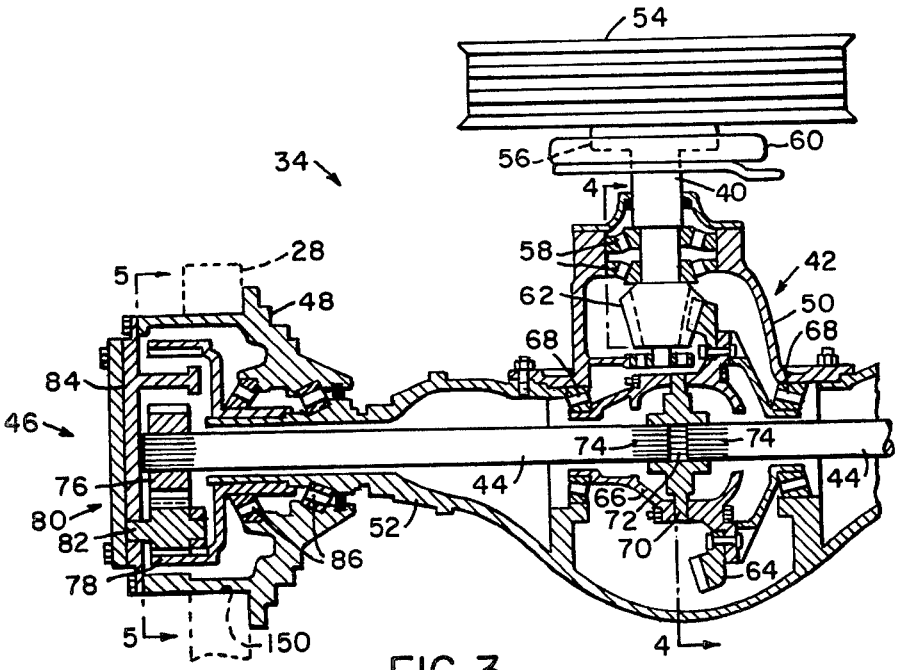
FIG. 3 is a sectional top view of the preferred power transmitting device as would be generally viewed along line 3—3 of FIGS. 1 and 2.

This invention is directed to the power transmitting device 34 which is shown in FIGS. 3, 4 and 5 and will be discussed in detail hereinbelow. However, it is sufficient for a general understanding of the oil well pump 10 to know that a rotating power source 36 can be coupled through a pulley and belt or chain drive means 38 to a single input shaft of the power transmitting device 34. The power source 36, as shown in FIGS. 1 and 2, includes an electric motor, although a diesel or gas engine might be utilized in some installations. The electric motor has an output pulley mounted on the output end thereof. In the embodiment shown in FIGS. 1 and 2, the pulley drives a belt means which is received around and drives a pulley directly coupled to the input shaft of the power transmitting device 34. It should be clear to those skilled in the art that some speed reduction can be obtained by the proper selection of the pulleys for the motor and the input shaft to the power transmitting device 34 but there are practical limitations including belt wear or life and the ability to transmit the power without slippage if there is too great a difference in the diameters of the pulleys.

As thus described, most of the features of the oil well pump 10 are typical of those found in a number of installations presently being employed in the oil industry. However, one would normally expect to see the power source 36 oriented with its axle in general alignment with the axis of rotation of the crank arms 28 since the pulley and belt drive usually provide power to an input shaft which is parallel to the output shaft of a different type of power transmitting, speed reducing device than the device 34. As mentioned hereinabove, such a previously employed power transmitting, speed reducing device would likely include spur, helical or herringbone gears mounted on shafts with their axes in parallel to provide for the desired transmission of power and reduction of speed. However, the orientation of the power source 36, as shown in FIGS. 1 and 2, would be consistent with the utilization of a worm gear configuration as also disclosed in some of the patents mentioned hereinabove.

In either case, as thus far described, the oil well pump 10 does not include any features, with the exception of the power transmitting device 34, which are not generally known in the oil industry. It should be kept in mind that the oil well pump 10 is merely representative of any number of equally suitable configurations which can be utilized to employ the rotating motion of a crank arm to produce the reciprocating action needed to operate an oil well pump. Consequently, it will be seen that any number of configurations shown in the patents mentioned hereinabove could be readily adapted to utilize the power transmitting device 34 as a means for taking power from a single rotating power source and converting it to a slower rotating pair of output means which can provide power to a pair of crank arms.

As seen in FIGS. 3, 4 and 5, the preferred power transmitting device 34 includes an input shaft 40 which drives a first speed reducing means 42. The first speed reducing means 42 is directly coupled to a pair of output shafts 44 extending outwardly at each side thereof. Each output shaft 44 is coupled at its outer end to a second speed reducing means 46. Each second speed reducing means includes a hub or output fitting 48 which can be directly coupled to a crank arm to produce the rotary motion which can then be converted to reciprocal motion in a manner described hereinabove. In other words, speed reduction provided by the preferred power transmitting device 34 is accomplished in two stages. The first speed reducing means 42 is centrally located in the power transmitting device 34 and converts rotating torsional power from the input shaft 40 to the output shafts 44 which are not aligned with the input shaft 40. The output shafts 44 then supply torsional power to the second speed reducing means located at their outer ends to impart rotation to the crank arms about a common axis of rotation but at a significantly slower rotational speed than that produced by the power source.

To properly support and provide lubrication for the first speed reducing means 42, the second speed reducing means 46 and other elements associated with the power transmitting device 34, the rotating elements are housed within a sealed container which includes a sufficient lubricating oil for splash lubrication or other lubricating means well known in the power transmitting field. Specifically, the first speed reducing means 42 is supported by and mounted within a housing 50. Output shaft housing 52 is mounted to extend to each side of the housing 50 to receive the output shafts 44 therein. The housing 50 and the shaft housing 52 combine to provide integrity for the power transmitting device 32. Additionally, the housings 50 and 52 include bearings for the support of the rotating members found in the power transmitting device 34 and sufficient fixed and running oil seal means to retain lubricant oil for the operation of both the first speed reducing means 42 and the second speed reducing means 46.

The input to the power transmitting device 34 includes a pulley 54 which is driven by the power source and secured to an outward end 56 of the input shaft 40. The input shaft 40 is mounted for rotation at bearings 58 which are secured to and supported by the housing 50. A brake 60 is also mounted about the outer end 56 of the shaft 40 and provides a selectively operated means to insure against rotation of the power transmitting device 34 during initial assembly or maintenance of the oil well pump.

The inward end of the input shaft 40 includes a pinion bevel gear means 62 which is in driving engagement with a ring bevel gear means 64 of the first speed reducing means 42. In the preferred embodiment, the first speed reducing means is not, in fact, technically a true bevel gear configuration in that the axis of rotation of the shaft 40 does not intersect the axis of rotation of the ring gear 64. Although it would be possible to utilize such a bevel gear arrangement to provide both for speed reduction and to convert the input rotation to rotation about a differently oriented axis, the preferred pinion gear 62 and ring gear 64, specifically shown in FIGS. 3 and 4, are of a hypoid-type which requires the input shaft 40 to be aligned above the axis of the ring gear 64 thus preventing any intersection of their axes. More technically, this could be described as a skew bevel gear arrangement with the hypoid-type of gears having a particular tooth design which has been commonly utilized in and accepted by the automotive industry for speed reduction and the transmission of power from one input shaft to two output shafts. As will be made clear hereinbelow, the hypoid-type pinion and ring gear configuration is considered the preferred because of its efficiency and the fact that it has been proven to be highly reliable and satisfactory in the automotive industry. Therefore, although the hypoid-type is the preferred, any number of bevel gear configurations might be utilized and, in fact, such a spiral bevel gear means has been satisfactorily employed in one embodiment.

The ring gear 64 is formed on a casing 66 which is supported for rotation within the housing 50 at bearings 68. The casing 66 preferably includes a spider 70 having four outwardly extending posts rigidly retained thereby. The spider 70 has a splined central bore 72 which receives the splined inward ends 74 of each shaft 44. While this configuration is the preferred, it should be clear that any means for rigidly securing the ring gear to the inward ends of the shafts 44 would be acceptable. In fact, there is no requirement that the shafts 44 be independent, although this is desirable in the preferred embodiment for a number of reasons which will be discussed in detail hereinbelow. The ring gear 64 could be directly mounted at an intermediate location on a single shaft with its opposite ends extending outwardly of the ring gear 64.

As thus described, the first speed reducing means 42 in one embodiment which has been satisfactorily employed in an oil well pump provides a speed reduction of 7.8 to 1. Although a greater amount of reduction may be obtained from a bevel gear configuration, a skewed bevel gear configuration or a hypoid-type gear configuration, the amount of reduction selected in the preferred embodiment is sufficient because of the existence of the second speed reducing means 46. However, as mentioned heretofore, if the power source were to be operated at a slower speed or if the pulley and belt configuration were to be so selected, it might be possible for the first speed reducing means to be utilized exclusively for reducing the speed in a power transmitting device. In other words, the shafts 44 could be employed to be directly coupled to a crank arm configuration for the operation of the oil well pump.

However, in order to allow a higher operating speed for the power source, the preferred power transmitting device 34 employs the second speed reducing means 46 to further reduce the speed of the output shafts 44 and provide the hub 48 which can be directly coupled to the crank arm. The second preferred speed reducing means 46 is a planetary gear reducer. Specifically, the output shaft 44 has at its outer end a sun gear 76 of the second speed reducing means 46 rigidly mounted thereon. The second speed reducing means 46 also includes a ring gear 78 which is rigidly secured to the shaft housing 52 to prevent its rotation. Planetary gear means 80 is provided between the rotating sun gear 76 and fixed ring gear 78 to respond to rotation of the sun gear 76 by the output shaft 44. In the preferred embodiment, the planetary gear means 80 includes three planetary gears 82 which are evenly spaced circumferentially about the sun gear 76 and are mounted to and supported by an end plate and spider 84 of the hub 48. The hub 48 is mounted for rotation at bearings 86 which are mounted on the shaft housing 52. As thus explained, the hub 48 is supported by and capable of rotating relative to the shaft housing 52 and is driven by the planetary gears 82 secured thereto. Consequently, the sun gear 76 is retained inwardly of each of the planetary gears 82 which are, in turn, retained in their location by their being mounted within the ring gear 78.

As thus described, the preferred second speed reducing means 46 provides a speed reduction of 3.6 to 1. Therefore, the power transmitting device utilizes both the first speed reducing means 42 and the second speed reducing means 46 and provides an overall speed reduction of about 28 to 1. One embodiment of the preferred power transmitting device 34 has an efficiency of 94% which compares favorably with any of the prior art devices mentioned hereinabove. It should be kept in mind that although the preferred second speed reducing means 46 is a planetary gear reducer, it might be possible to employ other types of reduction gears at the ends of the output shafts 44 without unduly reducing the overall efficiency.

While explaining the preferred power transmitting device 34, it should be clear to those skilled in the art that various features could be modified while still satisfying the broad objective of the invention and without departing from the spirit of the invention as claimed. However, there are a number of features incorporated in the preferred power transmitting device 34 to satisfy of a number of other objectives of this invention. As mentioned hereinabove, any power transmitting, speed reducing device to be used in an oil well pump should be efficient, reliable and relatively inexpensive to provide. Although with the ever increasing demand for oil products, there has been and will continue to be a large demand for oil well pumps, the scale of production of a power transmitting device which can only be used in the oil industry would significantly add to the cost of such a device. In other words, while the potential market for such a power transmitting device in the oil industry might require sufficient production quantities to justify a unique design which requires capital inventment in heavy equipment industry, machinery and tooling, it would, obviously, be desirable to have a design which utilized existing components as much as possible.

The utilization of components from an existing vehicle drive system used in the automotive industry would, obviously, be advantageous. Components extensively found and successfully employed in such a large, established industry would possess proven reliability and insure a valuable source of supply parts should they be necessary. From a production viewpoint, if parts or whole components presently being utilized in a vehicle drive system could be directly employed in a preferred power transmitting device 34, there would be no need for initial capital expenditure in special equipment or tooling as might be required for a totally unique design. Therefore, while there is a significant demand for a new power transmitting device in the oil industry, if could in no way compare to the number of vehicle drive systems which are presently in production. The economic impact of providing various components for such a power transmitting device in the oil industry would be significantly reduced by the utilization of such components from the automotive industry. Furthermore, a number of characteristics found in the vehicle drive systems which have been incorporated to gain acceptance in and meet the approval of the automotive industry are also attractive for this type of application in the oil industry.

Figure 6:
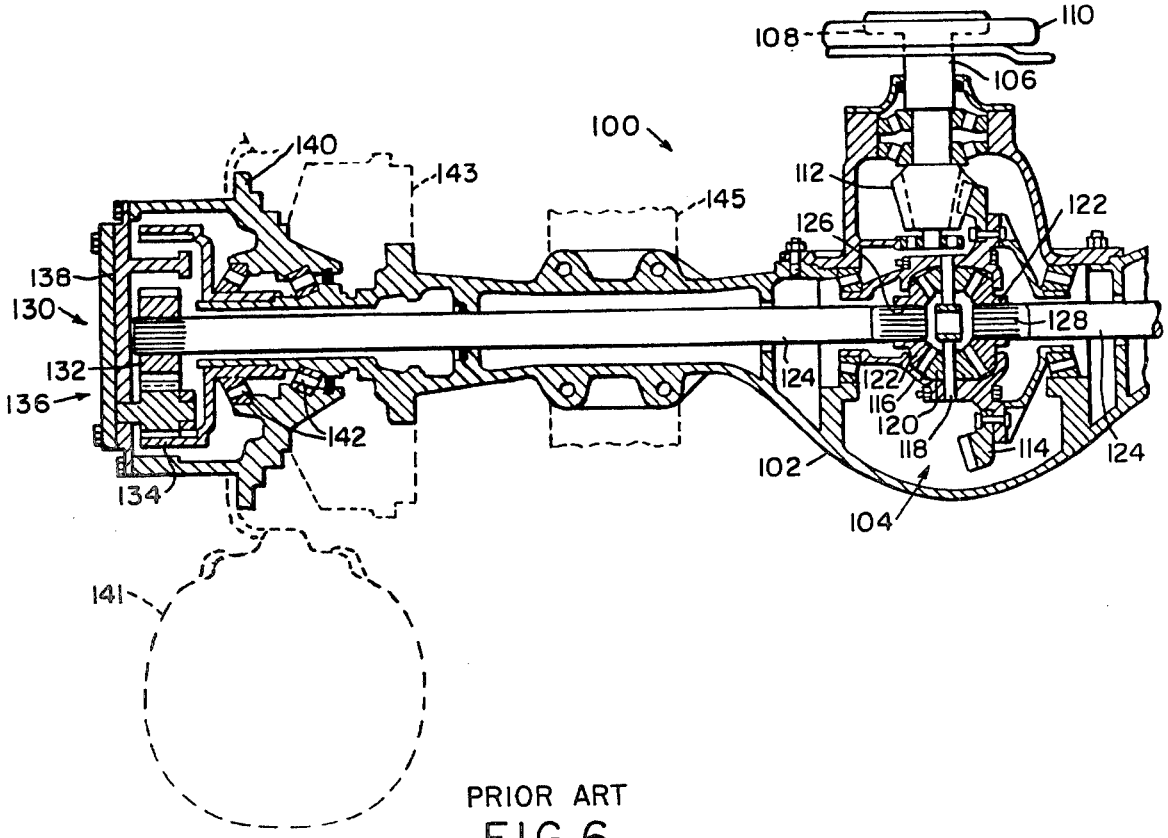
PRIOR ART FIG. 6
FIG. 6 is a prior art vehicle drive system which includes a number of elements which are capable of being directly utilized to manufacture the embodiment of the invention as shown in FIG. 3.

As seen in FIG. 6, an existing, rather typical vehicle drive system 100 includes a drive axle housing 102 with a centrally located differential 104 of a type which is well known in the art. An input drive shaft 106 is capable of being coupled at its outer end 108 to a vehicle drive shaft from the transmission, transfer case, or other power transmitting device in the vehicle (not shown). The input shaft 106 can include a parking brake 110 mounted on the housing 104 to be selectively operated to prevent rotation of the shaft 106. A pinion gear 112 of the hypoid-type is utilized to drive a hypoid-type ring gear 114 of a differential casing 116. A spider 118 is secured within the differential casing 116 and includes four differentially pinion gears 120 mounted for rotation thereon. The pinion gears 120 are in meshing engagement with a pair of side gears 122. Each side gear 122 includes a splined central bore 126 and is received upon the splined end 128 of a drive axle 124.

As mentioned hereinabove, the preferred hypoid-type pinion and ring gears, which are commonly found in such differentials and have been satisfactorily and extensively employed in the automotive industry to efficiently transmit power from a single input shaft to a pair of output axles, inherently provides the desired speed reduction. These types of gears are considered to be more efficient than the helical, spur, herringbone or worm gear configurations mentioned hereinabove. While this pinion and ring gear configuration, as suggested above, might provide satisfactory speed reduction for some applications, there are other applications in the automotive industry requiring further speed reduction. Some heavy duty off-highway vehicles and other vehicles, such as fork lift trucks, are generally operated at a lower speed than the conventional automobile or heavy duty on-highway vehicles. For such a low speed operation, it is desirable to have a further reduction of speed at the wheel end of the vehicle.

Accordingly, the existing vehicle drive system 100 also includes a planetary gear reducer 130 at the outward end of each drive axle 124. Specifically, the planetary gear reducer 130 would include a sun gear 132 rigidly secured to the end of the drive axle 124 with a ring gear 134 rigidly mounted to the axle housing 102. A planetary drive means 136 is secured to an end plate and spider 138 of a hub 140 to transmit the rotating power of the drive axle 124 the hub 140 causing it to rotate. The hub 140 is mounted at bearings 142 on the axle housing 102 for its rotation and support independent of the drive axle 124 and would have wheels and tires (not shown) mounted thereon to support and power the vehicle. Many different types of brakes 143 and suspensions 145 can be utilized to complete the drive axle system 100 as it would typically be seen on a vehicle.

As thus described, it can be seen that the vehicle drive system 100 might appear to be capable of being directly utilized as a power transmitting device for an oil well pump. However, the differential action resulting from the inclusion of a differential would be undesirable because it is essential for the crank arms of an oil well pump to move simultaneously and to be as evenly loaded as possible.

Although the typical vehicle drive system includes a differential mechanism, it should be kept in mind that there are occasions in the operation of a vehicle when differentiation is not desired. In the automotive field it is well recognized that spin out or excessive slipage of one of the vehicle wheels is unattractive since the spinning wheel can prevent power from being applied to the other wheel which might have traction and be capable of moving the vehicle. Therefore, it is quite common for vehicle drive systems similar to system 100, to include a means for selectively preventing the relative rotation of the drive axles 124. One such means includes a device for applying a braking force to the end of the differential casing to prevent it from rotating relative to one of the drive axles 124 and thus cause both drive axles 124 and the differential casing 116 to rotate together. There are many other means employed in and accepted by the automotive industry for accomplishing this objective. Since there are selective means for preventing the relative rotation of the drive axles 124, it should be clear that some means can be employed to modify or alter a differential to prevent the relative rotation of the drive axles 124 throughout operation of the vehicle drive system.

With this possibility in mind, it can be seen that specific limited modification of a vehicle drive system of the automotive industry would enable it to be employed to provide a power transmitting means for an oil well pump. However, many such vehicle drive systems would be considered too long to be directly installed in existing oil well pump configurations. One practical limitation on existing pumps is the distance between the pitmen and, therefore, the length of the equalizing connector. The length is determined by the desire to be able to transport oil well pumps of this type. In other words, an oil well pump, such as the type shown in FIGS. 1 and 2, is often designed to be mounted on a large transport truck to be capable of being taken from one oil well site to another. Transporting in this manner requires the use of public highways and thus limits the overall width of such an oil well pump configuration. However, if the oil well pump is intended to be permanently installed on one site or is to be utilized at multiple sites in a large field without use of the public highways, it might be possible for any number of vehicle drive systems to be directly employed if the differentials are modified to prevent the relative rotation of the drive axles. In fact, some fork lift trucks have a short wheel base and include vehicle drive systems with an overall length consistent with this practical limitation for oil well pumps.

Although it would be possible in some installations to directly employ an existing vehicle drive system with minimum modifications, the existing vehicle drive system does include some elements which can be eliminated and are eliminated in the preferred embodiment. Obviously, if a specific component can be designed to be better employed in an oil well pump configuration while reducing the overall cost of the power transmitting device, such a design would be attractive. Accordingly, rather than having a spider 118 having differential pinions 120 mounted thereon, the preferred embodiment utilizes a spider 70 which eliminates the differential pinion gears 120. Additionally, since the output shafts are not to be driven through a differential, there would be no need for side gears 122. As a result, the prefered power transmitting device 34 utilizes the spider 70 and includes a means for directly coupling the shafts 44 thereto.

Similarly, since, as mentioned hereinabove, the overall length in this application is less than the overall length of the vehicle drive system 100, the existing drive axles 124 are not utilized but a specifically shorter drive shaft 44 has been selected. Because of the reduction in the length of the drive shaft 44 versus the length of the drive axle 124, the outwardly extending portions of the axle housing 102 which support the hub 140 would be too long so that a shorter shaft housing 52 has been employed.

It can, therefore, be seen that the preferred power transmitting device 34 can be manufactured by using many existing components from the vehicle drive system 100. Specifically, the pinion gear 62 is identical to the pinion gear 112. The ring gear 64 is identical to the ring gear 114. Similarly, the casing 66 is identical to the differential casing 116. All of the components at the end of the shaft 44 are identical to those found in the vehicle drive system 100 so that the second speed reducing means 46 and hub 48 are identical to the planetary gear reducer 130 and wheel hub 140. Even the parking brake 110 can be directly utilized to provide the brake 60. Additionally, any number of bearings and seals which are found in the vehicle drive system 100 can be and are directly utilized in the preferred power transmitting device 34.

As explained hereinabove, the preferred power transmitting device 32 can be efficiently and reliably employed in an oil well pump. However, there are also additional characteristics which make it particularly attractive and unique as a power transmitting device for this purpose. As mentioned above, the crank arms 28 can be directly coupled to the hubs 48. As seen in FIGS. 1 and 2, the crank arm 28 is mounted to the hub 48 at a large hole 150 therein which does not overlie or interfere with the end plate and spider 84 of the hub 48. As a result, any repair to the planetary reduction gears of the second speed reducing means 46 can be accomplished without uncoupling the crank arm 28 from the hub 48 or requiring its removal. A review of the prior art devices shown in the patents mentioned hereinabove, reveals that the crank arms are usually directly mounted to the output shafts. Consequently, any work to be done to the power transmitting devices in these prior art installations would require the removal of the crank arm and, therefore, significantly complicate maintenance or repair. In fact, power transmitting device 34 includes the same repair and maintenance capabilities as the vehicle drive system 100 which is commonly employed and recognized as essential in the automotive industry. Any failure of rotating components in the vehicle drive system 100 can be corrected without requiring the removal of the hubs 140. In fact, all of the internal components can be removed by extraction at the outer ends of the drive axle housing 102 or the differential cover. As a result, any failure of the rotating components within the power transmitting device 34 can be corrected without significant down time for the oil well pump. In fact, the input shaft 40, the ring gear 64, the shafts 44 and the operating gears of the planetary gear reducer could all be completely replaced in the field in about two hours. Should such repairs be necessary, it should be kept in mind that the utilization of many components which are currently being used in the automotive industry insures that satisfactory and reliable spare parts can be obtained. The availability of these components as spare parts in the automotive industry insures their availability for the oil industry.

There is yet another advantage of looking to the automotive industry for a solution to the power transmitting problems in the oil industry. In the present explanation, it may have seemed that one particular form of the preferred embodiment could be utilized to satisfy oil well pump requirements. However, when providing a power transmitting device 32, an analysis of the forces required in the oil well pump and the speed reduction required for a given power source is taken into consideration. These requirements, as a practical matter, are different for different oil wells. Therefore, in the oil industry, there are usually provided a wide range of oil well pump configurations from which a selection is made to satisfy the particular job required. However, in the automotive industry there is also a wide range of vehicle drive requirements. It has been found that with the simple modifications mentioned above, a wide range of requirements for the oil well pump can be satisfied from the wide range of existing vehicle drive system configurations. Therefore, not only does the utilization of components from the automotive industry reduce the production and repair costs which would otherwise be required for a power transmitting device in the oil industry, but it also includes a wide range of such products so that a similar wide range of power transmitting devices can be properly employed in the oil industry.

As thus explained, the preferred power transmitting device 34 can be readily and inexpensively provided for utilization in an oil well pump. The particular configuration of one speed reduction means with additional speed reduction means mounted at the ends thereof provides power transmission which is more efficient than many of the systems presently employed. Additionally, this configuration includes means for facilitating maintenance and the replacement of spare parts should they be required.

While the embodiment presented hereinabove is the preferred embodiment, it has been made clear that a number of alterations could be made without departing from the spirit of the invention as claimed.

We claim:

1. A power transmitting device for an oil well pump of the type which utilizes a rotating power source and provides an output capable of operating crank means for driving a reciprocating pump means, said power transmitting device comprising:

a first speed reduction means including an input shaft means having pinion bevel gear means mounted thereon, said input shaft means being operably connected to said power source;

said first speed reduction means including a ring bevel gear means in meshing engagement with said pinion bevel gear means and being fixedly mounted at an intermediate location on a rotatable output shaft means;

a second speed reduction means connected to each of opposite ends of said output shaft means said first speed reduction means includes a housing;

a shaft housing around said each of said opposite ends of said output shaft means, each of said shaft housings being sealably secured to said housing of said first reduction means and each of said second speed reduction means is sealably joined to its respective said shaft housing whereby said housing, said shaft housing, and said second speed reduction means are capable of retaining lubricating oil for said power transmitting device;

said second speed reduction means including a planetary gear reducer and an output hub which is mounted for rotation on bearings mounted on said shaft housing; and said crank means being operably connected to said output hub.

2. The power transmitting device as set forth in claim 1, wherein said bevel gear means is of the skewed type in which said input shaft means is mounted in a plane which is perpendicular to said output shaft means but without intersecting said output shaft means.

3. The power transmitting device as set forth in claim 2, wherein said pinion bevel gear means and said ring bevel gear means which are skewed are of the hypoid-type.

4. A method of making a power transmitting device for an oil well pump of the type which utilizes a rotating power source and provides an output capable of operating crank means for driving a reciprocating pump means, said method comprising:

providing components from an automotive drive system, said components including an input shaft capable of being operably connected to said power source, a pinion bevel gear means mounted on said input shaft, a differential casing having ring gear means mounted thereon, a pair of planetary gear reducers including a sun gear, ring gear and a plurality of planetary gears mounted within a wheel hub to which said crank means can be secured, first bearing means for said input shaft, second bearing means for said differential casing and third bearing means for said wheel hub;

forming a connecting element with a central bore therethrough;

mounting said connecting element within said differential casing;

forming a housing having a central portion and two outwardly extending tubular portions;

installing said input shaft on said first bearing means and said differential casing on second bearing means within said central portion of said housing with said pinion bevel gear means and said ring bevel gear means in meshing engagement forming a pair of output shafts;

installing a first end of each of said output shafts rigidly within said central bore at opposite sides of said connecting element with said each of said output shafts extending outwardly therefrom within an interview of said tubular portions of said housing; and mounting one of said planetary gear reducer on an extended end of each of said tubular portions with said ring gear being rigidly mounted thereon, said wheel hub being mounted for rotation at said third bearing means about the outer surface thereof, and said sun gear being rigidly secured to a second end of said output shaft for rotation therewith.

5. A method as set forth in claim 4, wherein said pinion bevel gear means and said ring bevel gear means are hypoid gears.

6. A method as set forth in claim 4, wherein said automotive drive system includes a plurality of fixed and running oil seals, said housing is formed to match said oil seals, and said oil seals are installed to be capable of retaining lubricating oil within said housing.

7. A method as set forth in claim 4, further including the step of installing an automotive parking brake on said input shaft for selectively preventing undesired movement of said power transmitting device.

* * * * *